US008979606B2

(12) United States Patent
Ma

(10) Patent No.: US 8,979,606 B2
(45) Date of Patent: Mar. 17, 2015

(54) METHOD OF MANUFACTURING A RUTHENIUM-BASED SPARK PLUG ELECTRODE MATERIAL INTO A DESIRED FORM AND A RUTHENIUM-BASED MATERIAL FOR USE IN A SPARK PLUG

(71) Applicant: Federal-Mogul Ignition Company, Southfield, MI (US)

(72) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/922,632

(22) Filed: Jun. 20, 2013

(65) Prior Publication Data

US 2013/0344765 A1 Dec. 26, 2013

Related U.S. Application Data

(60) Provisional application No. 61/664,348, filed on Jun. 26, 2012.

(51) Int. Cl.
*H01T 21/02* (2006.01)
*H01T 13/39* (2006.01)

(52) U.S. Cl.
CPC ..... *H01T 21/02* (2013.01); *H01T 13/39* (2013.01)
USPC ..... 445/7; 428/577

(58) Field of Classification Search
CPC ..... H01T 21/02; H01T 13/39
USPC ..... 445/7, 47, 49; 313/118; 428/577
See application file for complete search history.

(56) References Cited

U.S. PATENT DOCUMENTS

| | | | |
|---|---|---|---|
| 2,328,580 | A | 9/1943 | Pickus |
| 2,391,456 | A | 12/1945 | Hensel |
| 2,391,457 | A | 12/1945 | Carlson |
| 2,406,172 | A | 8/1946 | Smithells |
| 2,470,034 | A | 5/1949 | Hensel |
| 2,545,438 | A | 3/1951 | Stumbpck |
| 3,159,460 | A | 12/1964 | Hill |
| 3,278,280 | A | 10/1966 | Holtz |
| 3,362,799 | A | 1/1968 | Jones et al. |
| 3,466,158 | A | 9/1969 | Rhys |
| 3,528,862 | A | 9/1970 | Jones et al. |
| 3,868,430 | A | 2/1975 | Giangaspero |
| 3,868,530 | A | 2/1975 | Eaton et al. |
| 3,957,451 | A | 5/1976 | Rasmussen et al. |

(Continued)

FOREIGN PATENT DOCUMENTS

| | | |
|---|---|---|
| DE | 10005559 | 8/2001 |
| GB | 556253 | 9/1943 |

(Continued)

*Primary Examiner* — Britt D Hanley
*Assistant Examiner* — Steven Horikoshi
(74) *Attorney, Agent, or Firm* — Reising Ethington P.C.

(57) ABSTRACT

A method of making an electrode material for use in spark plugs and other ignition devices including industrial plugs, aviation igniters, glow plugs, or any other device that is used to ignite an air/fuel mixture in an engine. The electrode material is a ruthenium-based material that includes ruthenium as the single largest constituent. The disclosed method includes hot-forming a layered structure that includes a ruthenium-based material core, an interlayer having a refractory metal disposed over the ruthenium-based material core, and a nickel-based cladding disposed over the interlayer.

18 Claims, 4 Drawing Sheets

(56) References Cited

U.S. PATENT DOCUMENTS

| | | | |
|---|---|---|---|
| 2,977,841 | A | 8/1976 | Rasmussen et al. |
| 4,324,588 | A | 4/1982 | Zysk et al. |
| 4,351,095 | A | 9/1982 | Davies |
| 4,427,915 | A | 1/1984 | Nishio et al. |
| 4,659,960 | A | 4/1987 | Toya |
| 4,692,657 | A | 9/1987 | Grunwald et al. |
| 4,743,793 | A | 5/1988 | Toya et al. |
| 4,771,209 | A | 9/1988 | Ryan |
| 4,786,267 | A | 11/1988 | Toya et al. |
| 4,881,913 | A | 11/1989 | Mann |
| 4,910,428 | A | 3/1990 | Strumbos |
| 4,939,409 | A | 7/1990 | Freise et al. |
| 5,101,135 | A | 3/1992 | Oshima |
| 5,347,193 | A | 9/1994 | Oshima |
| 5,448,130 | A | 9/1995 | Matsutani et al. |
| 5,456,624 | A | 10/1995 | Moore |
| 5,461,275 | A | 10/1995 | Oshima |
| 5,514,929 | A | 5/1996 | Kawamura |
| 5,550,425 | A | 8/1996 | Yoder |
| 5,578,895 | A | 11/1996 | Oshima |
| 5,675,209 | A | 10/1997 | Hall, Jr. |
| 5,793,793 | A | 8/1998 | Matsutani et al. |
| 5,796,019 | A | 8/1998 | Lupton |
| 5,866,973 | A | 2/1999 | Kagawa et al. |
| 5,869,921 | A | 2/1999 | Matsutani |
| 5,890,272 | A | 4/1999 | Liberman |
| 5,894,186 | A | 4/1999 | Matsutani et al. |
| 5,898,257 | A | 4/1999 | Sequerra et al. |
| 5,990,602 | A | 11/1999 | Katoh et al. |
| 5,997,695 | A | 12/1999 | Limarinen |
| 5,998,913 | A | 12/1999 | Matsutani et al. |
| 6,045,424 | A | 4/2000 | Chang et al. |
| 6,046,532 | A | 4/2000 | Matsutani |
| 6,071,163 | A | 6/2000 | Chang et al. |
| 6,094,000 | A | 7/2000 | Osamura et al. |
| 6,095,124 | A | 8/2000 | Matsubara et al. |
| 6,121,719 | A | 9/2000 | Matsutani et al. |
| 6,166,479 | A | 12/2000 | Matasutani et al. |
| 6,262,522 | B1 | 7/2001 | Osamura et al. |
| 6,304,022 | B1 | 10/2001 | Matsutani et al. |
| 6,326,719 | B1 | 12/2001 | Boehler |
| 6,407,487 | B1 | 6/2002 | Sugimoto |
| 6,412,465 | B1 | 7/2002 | Lykowski |
| 6,523,515 | B2 | 2/2003 | Kanao |
| 6,533,628 | B1 | 3/2003 | Matsutani |
| 6,579,738 | B2 | 6/2003 | Farrar |
| 6,611,083 | B2 | 8/2003 | LaBarge et al. |
| 6,628,051 | B1 | 9/2003 | Menken |
| 6,664,719 | B2 | 12/2003 | Matsutani et al. |
| 6,750,597 | B1 | 6/2004 | Sakura |
| 6,790,113 | B1 | 9/2004 | Fujita |
| 6,794,803 | B2 | 9/2004 | Hori et al. |
| 6,798,125 | B2 | 9/2004 | Sugiyama et al. |
| 6,864,622 | B2 | 3/2005 | Matsutani et al. |
| 6,869,328 | B2 | 3/2005 | Ulm et al. |
| 7,084,558 | B2 | 8/2006 | Teramura et al. |
| 7,131,191 | B2 | 11/2006 | Matsutani et al. |
| 7,132,782 | B2 | 11/2006 | Kato et al. |
| 7,150,252 | B2 | 12/2006 | Sugiyama et al. |
| 7,164,225 | B2 | 1/2007 | Yoshimoto et al. |
| 7,221,078 | B2 | 5/2007 | Watanabe |
| 7,279,827 | B2 | 10/2007 | Nunome et al. |
| 7,288,879 | B2 | 10/2007 | Matsutani et al. |
| 7,321,187 | B2 | 1/2008 | Teramura et al. |
| 7,336,024 | B2 | 2/2008 | Yoshimoto et al. |
| 7,382,084 | B2 | 6/2008 | Yoshimoto et al. |
| 7,385,339 | B2 | 6/2008 | Lineton et al. |
| 7,449,823 | B2 | 11/2008 | Menken et al. |
| 7,569,979 | B2 | 8/2009 | Lykowski et al. |
| 7,637,793 | B2 | 12/2009 | Lintunen et al. |
| 7,815,849 | B2 | 10/2010 | Koch et al. |
| 2002/0024160 | A1 | 2/2002 | Sugimoto |
| 2003/0178925 | A1 | 9/2003 | Kumagai |
| 2004/0140745 | A1 | 7/2004 | Hrastnik |
| 2005/0168121 | A1 | 8/2005 | Tinwell |
| 2005/0179353 | A1 | 8/2005 | Watanabe |
| 2006/0158082 | A1 | 7/2006 | Menken |
| 2007/0057613 | A1 | 3/2007 | Brady |
| 2007/0190364 | A1 | 8/2007 | Das |
| 2007/0236123 | A1 | 10/2007 | Lykowski |
| 2007/0236124 | A1 | 10/2007 | Lykowski |
| 2008/0074025 | A1 | 3/2008 | Hori |
| 2008/0206601 | A1 | 8/2008 | Mukai |
| 2008/0308057 | A1 | 12/2008 | Lykowski |
| 2009/0284117 | A1 | 11/2009 | Lykowski |
| 2010/0026159 | A1 | 2/2010 | Ohm |
| 2010/0052497 | A1 | 3/2010 | Walker, Jr. |
| 2010/0109502 | A1 | 5/2010 | Nakayama |
| 2010/0117506 | A1 | 5/2010 | Suzuki et al. |
| 2010/0253203 | A1 | 10/2010 | Suzuki et al. |
| 2010/0264801 | A1 | 10/2010 | Tanaka |
| 2010/0264802 | A1 | 10/2010 | Tanaka |
| 2011/0043093 | A1 | 2/2011 | Nunome |
| 2011/0127900 | A1 | 6/2011 | Ma |
| 2011/0198983 | A1 | 8/2011 | Manhardt |
| 2012/0025690 | A1 | 2/2012 | Kohl |
| 2012/0025692 | A1 | 2/2012 | Ma |
| 2013/0285533 | A1* | 10/2013 | Ma ..... 313/141 |
| 2014/0015399 | A1* | 1/2014 | Ma ..... 313/141 |
| 2014/0103792 | A1* | 4/2014 | Ma ..... 313/141 |

FOREIGN PATENT DOCUMENTS

| | | |
|---|---|---|
| GB | 575998 | 3/1946 |
| GB | 717496 | 10/1954 |
| GB | 755835 | 8/1956 |
| GB | 830628 | 3/1960 |
| JP | 2207476 | 8/1990 |
| JP | 7268574 | 10/1995 |
| JP | 8339880 | 12/1996 |
| JP | 2000331770 | 11/2000 |
| JP | 2001262253 | 9/2001 |
| JP | 2002346625 | 12/2002 |
| JP | 2003053419 | 2/2003 |
| JP | 2004031300 | 1/2004 |
| JP | 2004235040 | 8/2004 |
| JP | 2008053017 | 3/2008 |
| JP | 2008053018 | 3/2008 |
| KR | 20020050486 | 6/2002 |

* cited by examiner

METHOD OF MANUFACTURING A RUTHENIUM-BASED SPARK PLUG ELECTRODE MATERIAL INTO A DESIRED FORM AND A RUTHENIUM-BASED MATERIAL FOR USE IN A SPARK PLUG

REFERENCE TO RELATED APPLICATIONS

This application claims the benefit of U.S. Provisional Ser. No. 61/664,348 filed on Jun. 26, 2012, the entire contents of which are incorporated herein.

TECHNICAL FIELD

This invention generally relates to spark plugs and other ignition devices for internal combustion engines and, in particular, to electrode materials for spark plugs and methods of making them.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

A method of manufacturing a spark plug electrode material into a desired form is disclosed. In one embodiment, the method comprises forming a core of a ruthenium-based material that has a length and a cross-sectional area. An interlayer that comprises a refractory metal is then disposed over an exterior surface of the ruthenium-based material core and a nickel-based alloy cladding is disposed over the interlayer. The resultant layered structure is then hot-formed to reduce the cross-sectional area of the ruthenium-based material core and to form an elongated layered wire. The claimed method further calls for removing the interlayer and the nickel-based alloy cladding from the ruthenium-based material core to derive an elongated ruthenium-based material wire.

In another embodiment, the method comprises providing a layered structure that comprises (1) a core of a ruthenium-based material that has a length dimension and a cross-sectional area oriented perpendicular to the length dimension, (2) an interlayer that comprises a refractory metal disposed over an exterior surface of the ruthenium-based material core, and (3) a nickel-based alloy cladding disposed over an exterior surface of the interlayer. The method also calls for hot-drawing and annealing the layered structure, repeated as necessary, to reduce the cross-sectional area of the ruthenium-based material core by at least 80% to form an elongated layered wire. The interlayer and the nickel-based alloy layer are then removed from the ruthenium-based material core to derive an elongated ruthenium-based material wire.

Also disclosed is a ruthenium-based material for use in a spark plug that can be manufactured by any of the methods disclosed herein.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
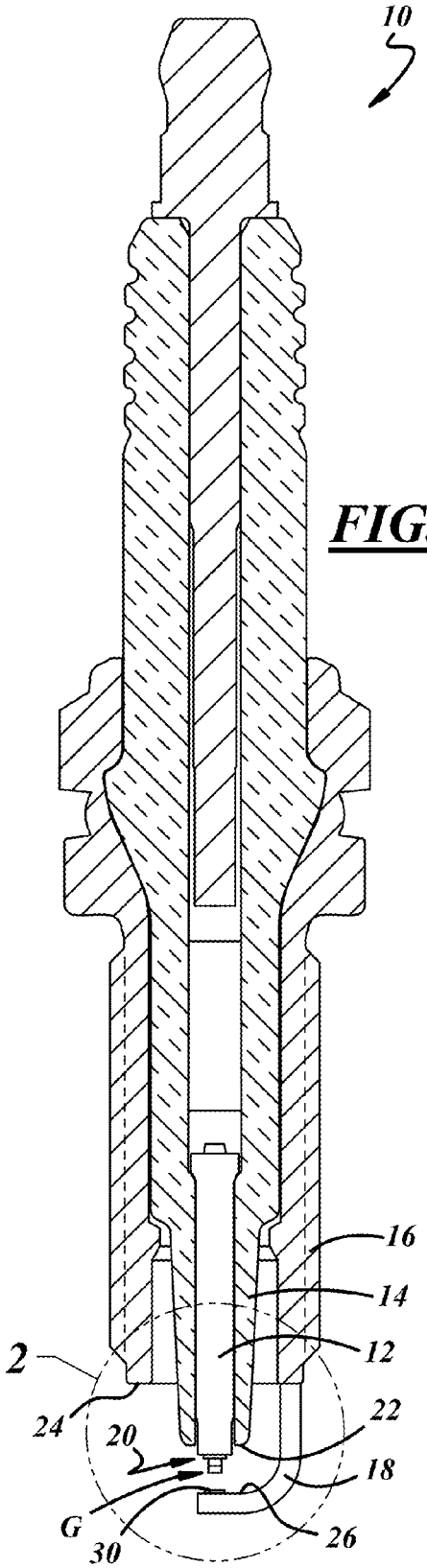
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible. All percentages provided herein are in terms of weight percentage (wt %).

Figure 2:
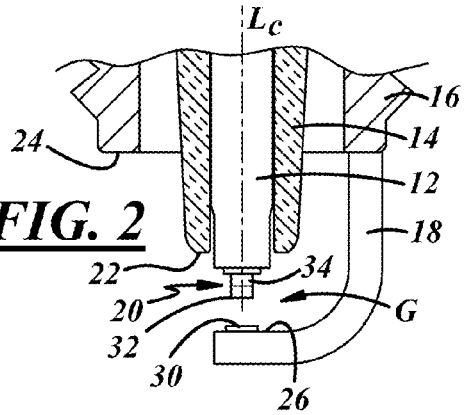
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components 32, 34 may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode 12 and has a firing tip 30 attached thereto. The firing tip 30 is in the form of a flat pad and defines a spark gap G with the center electrode firing tip 20 such that they provide sparking surfaces for the emission and reception of electrons across the spark gap G.

Figure 3:
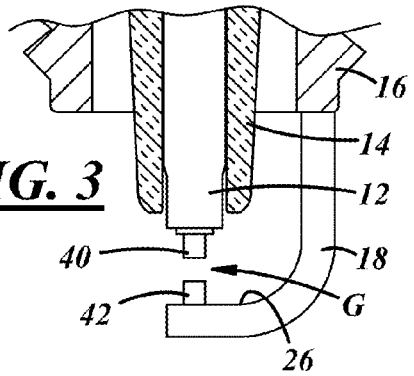
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
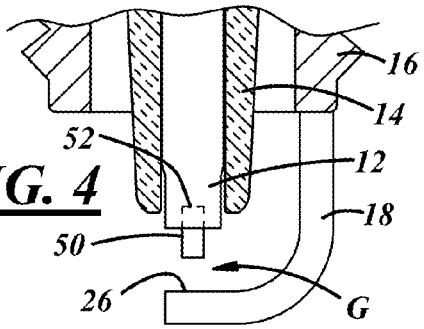
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
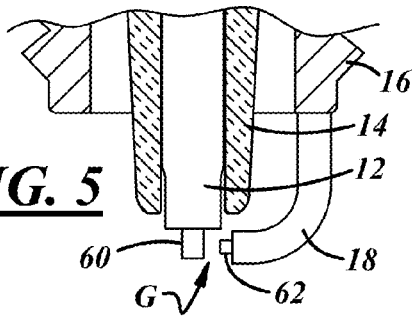
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52. The spark gap G is formed between a sparking surface of the center electrode firing tip 50 and a side surface 26 of the ground electrode 18, which also acts as a sparking surface. FIG. 5 shows yet another possible application for the electrode material. Here, the electrode material may be used to make the cylindrical firing tip 60 on an axial end of the center electrode 12 and/or the cylindrical firing tip 62 on an axial end of the ground electrode 18. The ground electrode firing tip 62 in this embodiment forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

The electrode material is a ruthenium-based material. The term "ruthenium-based material," as used herein, broadly includes any material in which ruthenium (Ru) is the single largest constituent on a weight percentage (%) basis. This may include materials having greater than 50 wt % ruthenium, as well as those having less than 50 wt % ruthenium so long as the ruthenium is the single largest constituent. One or more additional precious metals (ruthenium is considered a precious metal too) may also be included in the ruthenium-based material. Some examples of suitable additional precious metals are rhodium (Rh), iridium (Ir), platinum (Pt), palladium (Pd), gold (Au), and combinations thereof. Another possible constituent of the ruthenium-based material is one or more refractory metals. Several suitable refractory metals that may be included in the ruthenium-based material are rhenium (Re), tungsten (W), and a combination of rhenium and tungsten, among others. It is also possible for the ruthenium-based material to include one or more rare earth metals or active elements like yttrium (Y), hafnium (Hf), scandium (Sc), zirconium (Zr), lanthanum (La), cerium (Ce), and/or other constituents. Besides ruthenium, the ruthenium-based material does not necessarily have to include any or all of the types of metals just mentioned (e.g., the additional precious metals, refractory metals, and rare earth metals are optional); it may include only one of those types of metals, a combination of two or more of those types of metals, all of those types of metals, or none of those types of metals, as will be appreciated by a skilled artisan.

The following embodiments are examples of different ruthenium-based materials from which any of the electrodes or electrode components shown in FIGS. 1-5, as well as others not specifically shown, may be fabricated. It should be appreciated that these exemplary ruthenium-based materials are not meant to be an exhaustive list of all such embodiments, as others are certainly possible, and that other constituents not specifically mentioned may also be present. A periodic table published by the International Union of Pure and Applied Chemistry (IUPAC) is provided in Addendum A (hereafter the "attached periodic table") and is to be used with the present application.

The ruthenium-based material may include ruthenium and an additional precious metal such as, for example, at least one of rhodium, iridium, platinum, palladium, gold, or a combination thereof. Any of the following alloy systems may be appropriate: Ru—Rh, Ru—Ir, Ru—Pt, Ru—Pd, Ru—Au, Ru—Rh—Ir, Ru—Rh—Pt, Ru—Rh—Pd, Ru—Rh—Au, Ru—Ir—Pt, Ru—Ir—Pd, and Ru—Ir—Au. Some specific non-limiting examples of potential compositions for the ruthenium-based material include (the following compositions are given in weight percentage, and the Ru constitutes the balance): Ru-(1-45)Rh; Ru-(1-45)Ir; Ru-(1-45)Pt; Ru-(1-45)Pd; Ru-(1-45)Au; Ru-(1-20)Rh-(1-20)Ir; Ru-(1-20)Rh-(1-20)Pt; Ru-(1-20)Rh-(1-20)Pd; Ru-(1-20)Rh-(1-20)Au; Ru-(1-20)Ir-(1-20)Pt; Ru-(1-20)Ir-(1-20)Pd; Ru-(1-20)Ir-(1-20)Au; Ru-(1-20)Pt-(1-20)Pd; Ru-(1-20)Pt-(1-20)Au; Ru-(1-20)Pd-(1-20)Au; Ru-45Rh; Ru-40Rh; Ru-30Rh; Ru-25Rh; Ru-20Rh; Ru-15Rh; Ru-10Rh; Ru-5Rh; Ru-2Rh; Ru-1Rh; Ru-45Ir; Ru-40Ir; Ru-35Ir; Ru-30Ir; Ru-25Ir; Ru-20Ir; Ru-15Ir; Ru-10Ir; Ru-5Ir; Ru-2Ir; Ru-1Ir; Ru-45Pt; Ru-40Pt; Ru-35Pt; Ru-30Pt; Ru-25Pt; Ru-20Pt; Ru-15Pt; Ru-10Pt; Ru-5Pt; Ru-2Pt; Ru-1Pt; Ru-35Rh-20Ir; Ru-35Rh-20Pt; Ru-35Ir-20Rh; Ru-35Ir-20Pt; Ru-35Pt-20Rh; Ru-35Pt-20Ir; Ru-25Rh-20Ir; Ru-25Rh-20Pt; Ru-25Ir-20Rh; Ru-25Ir-20Pt; Ru-25Pt-20Rh; Ru-25Pt-20Ir; Ru-20Rh-20Ir; Ru-20Rh-20Pt; Ru-20Ir-20Pt; Ru-15Rh-15Ir; Ru-15Rh-15Pt; Ru-15Ir-15Pt; Ru-10Rh-10Ir; Ru-10Rh-10Pt; and Ru-10Ir-10Pt.

In another embodiment, the ruthenium-based material may include ruthenium and at least one refractory metal such as rhenium, tungsten, or a combination of rhenium and tungsten. Anywhere from about 0.1 wt % to 10 wt % of rhenium, anywhere from 0.1 wt % to 10 wt % of tungsten, or anywhere from 0.1 wt % to 10 wt % of rhenium and tungsten combined, if both are present, is preferably included in the ruthenium-based material. Rhenium and tungsten have melting points that are appreciably higher than ruthenium; thus, adding one or both of them to the ruthenium-based material can increase the overall melting temperature of the material. The melting point of rhenium is approximately 3180° C. and that of tungsten is around 3410° C. As those skilled in the art will appreciate, electrode materials having high melting temperatures are generally more resistant to electrical erosion in spark plugs, igniters, and other applications that are exposed to similar high-temperature environments.

The inclusion of rhenium and/or tungsten may also provide the electrode material with other desirable attributes—such as increased ductility and greater control of grain growth because of an increased recrystallization temperature. The inclusion of rhenium and/or tungsten may improve the ductility of the ruthenium-based material by increasing the solubility of some interstitial components (like nitrogen (N), carbon (C), oxygen (O), sulfur (S), phosphorus (P), etc.) with respect to ruthenium. Affecting the solubility of the interstitials in this way can help keep the interstitials from congregating at low-energy grain boundaries which, in turn, can render the ruthenium-based material more ductile and workable, particularly during high-temperature metal forming processes, and less susceptible to erosion through grain cleavage. Although ruthenium-based materials could be produced that include one of rhenium or tungsten, but not both, the co-addition of rhenium and tungsten in the ruthenium-based material may have a synergistic effect that contributes to an improvement in ductility.

The presence of rhenium and tungsten can increase the recrystallization temperature of the ruthenium-based material by 50° C.-100° C. due to the relatively high melting points of those two metals. An increase in the recrystallization temperature may be useful in controlling grain growth during certain hot forming processes like sintering, annealing, hot swaging, hot extruding, hot drawing, and even during use in a spark plug at high temperatures. For instance, the recrystallization temperature of the ruthenium-based material, when at least one of rhenium or tungsten is added, may be above 1400° C. Such an increase in the recrystallization temperature provides a larger temperature window in which hot metal forming processes may be practiced—for example, to fabricate a wire from which any of the firing tips shown in FIGS. 1-5 can be derived—without inducing grain growth in the grain structure of the ruthenium-based material. The ability to hot-form the ruthenium-based material without experiencing grain growth may be helpful for several reasons including, but not limited to, the preservation of a desired grain structure and the mitigation of crack initiation and propagation. The term "grain growth," as used herein, refers to growth in the volume of the grain during some type of high-temperature metal working process. Increased dimensional changes to the grain, such as during a hot drawing process of the ruthenium-based material in which the grains may become more elongated along the elongation axis, are not considered "grain growth" if the overall volume of the grain remains relatively constant.

Some embodiments of a ruthenium-based material that comprise at least one refractory metal include from about 40 wt % to 99.9 wt % of ruthenium and from about 0.1 wt % to 10 wt % of rhenium, from about 0.1 wt % to 10 wt % of tungsten, or from about 0.1 wt % to 10 wt % of some combination of rhenium and tungsten. Some non-limiting examples of potential compositions include (in the following compositions, the Ru constitutes the balance): Ru-10Re; Ru-5Re; Ru-2Re; Ru-1Re; Ru-0.5Re; Ru-0.1Re; Ru-10W; Ru-5W; Ru-2W; Ru-1W; Ru-0.5W; Ru-0.1W; Ru-9Re-1W, Ru-8Re-2W, Ru-7Re-3W, Ru-6Re-4W, Ru-5Re-5W, Ru-4Re-6W, Ru-3Re-7W, Ru-2Re-8W, Ru-1Re-9W, Ru-4Re-4W, Ru-3Re-3W, Ru-2Re-2W, Ru-1Re-1W, Ru-0.5Re-0.5W and Ru-0.1Re-0.1W. An exemplary ruthenium-based material that may be particularly useful in spark plug applications is Ru-(0.1-5)Re-(0.1-5)W, such as Ru-1Re-1W, but of course others are certainly possible. In a number of the exemplary ruthenium-based materials just mentioned, as well as those described below, the ratio of rhenium to tungsten is 1:1. But this ratio is not required. Other ratios may indeed be used as well.

According to yet another embodiment, the ruthenium-based material may include ruthenium, an additional precious metal, and at least one refractory metal. The ruthenium-based material may include ruthenium from about 40 wt % to 99.9 wt %, an additional precious metal—other than ruthenium—from about 0.1 wt % to 40 wt %, and at least one refractory metal from about 0.1 wt % to 10 wt %, provided that ruthenium is the largest single constituent. Some examples of suitable ruthenium-based materials having one additional precious metal and at least one refractory metal include the following alloy systems: Ru—Rh—Re, Ru—Rh—W, Ru—Ir—Re, Ru—Ir—W, Ru—Pt—Re, Ru—Pt—W, Ru—Pd—Re, Ru—Pd—W, Ru—Au—Re, Ru—Au—W, Ru—Rh—Re—W, Ru—Ir—Re—W, Ru—Pt—Re—W, Ru—Pd—Re—W, and Ru—Au—Re—W, all of which include ruthenium as the largest single constituent.

Some specific examples of potential compositions according to the embodiment just described include (in the following compositions, the Ru constitutes the balance, and the designation Re/W means a combination of rhenium and tungsten in which the corresponding numerical percentage pertains to the overall combination): Ru-(0.1-40)Rh-(0.1-10)Re, Ru-(0.1-40)Rh-(0.1-10)W, Ru-(0.1-40)Rh-(0.1-10)Re/W, Ru-40Rh-(0.1-10)Re/W, Ru-30Rh-(0.1-10)Re/W, Ru-20Rh-(0.1-10)Re/W, Ru-15Rh-(0.1-10)Re/W, Ru-10Rh-(0.1-10)Re/W, Ru-5Rh-(0.1-10)Re/W, Ru-2Rh-(0.1-10)Re/W, Ru-1Rh-(0.1-10)Re/W, Ru-40Ir-(0.1-10)Re/W, Ru-30Ir-(0.1-10)Re/W, Ru-20Ir-(0.1-10)Re/W, Ru-15Ir-(0.1-10)Re/W, Ru-10Ir-(0.1-10)Re/W, Ru-5Ir-(0.1-10)Re/W, Ru-2Ir-(0.1-10)Re/W, Ru-1Ir-(0.1-10)Re/W, Ru-40Pt-(0.1-10)Re/W, Ru-30Pt-(0.1-10)Re/W, Ru-20Pt-(0.1-10)Re/W, Ru-15Pt-(0.1-10)Re/W, Ru-10Pt-(0.1-10)Re/W, Ru-5Pt-(0.1-10)Re/W, Ru-2Pt-(0.1-10)Re/W, Ru-1Pt-(0.1-10)Re/W, Ru-40Pd-(0.1-10)Re/W, Ru-30Pd-(0.1-10)Re/W, Ru-20Pd-(0.1-10)Re/W, Ru-15Pd-(0.1-10)Re/W, Ru-10Pd-(0.1-10)Re/W, Ru-5Pd-(0.1-10)Re/W, Ru-2Pd-(0.1-10)Re/W, Ru-1Pd-(0.1-10)Re/W, Ru-40Au-(0.1-10)Re/W, Ru-30Au-(0.1-10)Re/W, Ru-20Au-(0.1-10)Re/W, Ru-15Au-(0.1-10)Re/W, Ru-10Au-(0.1-10)Re/W, Ru-5Au-(0.1-10)Re/W, Ru-2Au-(0.1-10)Re/W, and Ru-1Au-(0.1-10)Re/W. An few exemplary ruthenium-based materials that may be particularly useful in spark plug applications are Ru-(0.5-5)Rh—Re (0.1-5), such as Ru-5Rh-1Re, Ru-(0.5-5)Rh-(0.1-5)W, such as Ru-5Rh-1W, and Ru-(0.5-5)Rh-(0.1-5)Re/W, such as Ru-5Rh-1Re-1W. Of course other compositions are also possible as well.

In yet another embodiment, the ruthenium-based material may include ruthenium, a first additional precious metal, a second additional precious metal, and at least one refractory metal. The ruthenium-based material may include ruthenium from about 40 wt % to 99.9 wt %, a first additional precious metal—other than ruthenium—from about 0.1 wt % to 40 wt %, a second additional precious metal—other than ruthenium and the first additional precious metal—from about 0.1 wt % to 40 wt %, and a refractory metal from about 0.1 wt % to 10 wt %, provided that ruthenium is the largest single constituent. Some examples of suitable ruthenium-based materials having two additional precious metals and at least one refractory metal include the following alloy systems: Ru—Rh—Ir—Re, Ru—Rh—Ir—W, Ru—Rh—Ir—Re—W, Ru—Rh—Pt—Re, Ru—Rh—Pt—W, Ru—Rh—Pt—Re—W, Ru—Rh—Pd—Re, Ru—Rh—Pd—W, Ru—Rh—Pd—Re—W, Ru—Rh—Au—Re, Rh—Rh—Au—W, Ru—Rh—Au—Re—W, Ru—Ir—Pt—Re, Ru—Ir—Pt—W, Ru—Ir—Pt—Re—W, Ru—Ir—Pd—Re, Ru—Ir—Pd—W, Ru—Ir—Pd—Re—W, Ru—Ir—Au—Re, Ru—Ir—Au—W, Ru—Ir—Au—Re—W, Ru—Pt—Pd—Re, Ru—Pt—Pd—W, Ru—Pt—Pd—Re—W, Ru—Pt—Au—Re, Ru—Pt—Au—W, Ru—Pt—Au—Re—W, Ru—Pd—Au—R, Ru—Pd—Au—W, and Ru—Pd—Au—Re—W, all of which include ruthenium as the largest single constituent.

Some specific examples of the ruthenium-based material according to the present embodiment include (in the following compositions, the Ru constitutes the balance, and the designation Re/W means a combination of rhenium and tungsten in which the corresponding numerical percentage pertains to the overall combination): Ru-30Rh-30Ir-(0.1-10)Re, Ru-30Rh-30Ir-(0.1-10)W, Ru-30Rh-30Ir-(0.1-10)Re/W, Ru-20Rh-20Ir-(0.1-10)Re, Ru-20Rh-20Ir-(0.1-10)W, Ru-20Rh-20Ir-(0.1-10)Re/W, Ru-10Rh-10Ir-(0.1-10)Re, Ru-10Rh-10Ir-(0.1-10)W, Ru-10Rh-10Ir-(0.1-10)Re/W, Ru-5Rh-5Ir-(0.1-10)Re, Ru-5Rh-5Ir-(0.1-10)W, Ru-5Rh-5Ir-(0.1-10)Re/W, Ru-2Rh-2Ir-(0.1-10)Re, Ru-2Rh-2Ir-(0.1-10)W, Ru-2Rh-2Ir-(0.1-10)Re/W, Ru-1Rh-1Ir-(0.1-10)Re, Ru-1Rh-1Ir-(0.1-10)W, Ru-1Rh-1Ir-(0.1-10)Re/W, and corresponding compositions of Ru—Rh—Pt—Re, Ru—Rh—Pt—W, Ru—Rh—Pt—Re—W, Ru—Ir—Pt—Re, Ru—Ir—Pt—W, Ru—Ir—Pt—Re/W, to cite a few possibilities. It is also possible for the ruthenium-based material to include three or more additional precious metals, such as Ru—Rh—Ir—Pt—Re, Ru—Rh—Ir—Pt—W, Ru—Rh—Ir—Pt—Re/W, Ru—Rh—Pt—Pd—Re, Ru—Rh—Pt—Pd—W, Ru—Rh—Pt—Pd—Re/W, Ru—Rh—Pt—Au—Re, Ru—Rh—Pt—Au—W, and Ru—Rh—Pt—Au—Re/W. Some exemplary ruthenium-based electrode materials that may be particularly useful in spark plug applications are Ru-(0.5-5)Rh-(0.1-5)Ir-(0.5-5)Re, Ru-(0.5-5)Rh-(0.1-5)Ir-(0.5-5)W, Ru-(0.5-5)Rh-(0.1-5)Ir-(0.5-5)Re/W, Ru-(1-10)Rh-(1-10)Ir-(0.5-5)Re-(0.5-5)W, and Ru-(1-10)Rh-(1-10)Ir-(0.5-5)Re-(0.5-5)W, but other alloy compositions are possible as well.

Depending on the particular properties that are desired, and as demonstrated above, the amount of ruthenium in the ruthenium-based material may be: greater than or equal to 40 wt %, 50 wt %, 65 wt %, or 80 wt %; less than or equal to 99.9 wt %, 95 wt %, 90 wt %, or 85 wt %; or between 40-99.9 wt %, 50-99.9 wt %, 65-99 wt %, or 80-99 wt %, to cite a few examples. The amount of each additional precious metal (e.g., the first, second, third additional precious metal), moreover, so long as ruthenium is the single largest constituent, may be: greater than or equal to 0.1 wt %, 0.5 wt %, 1 wt %, or 2 wt %, less than or equal to 40%, 20%, 10%, or 5%; or between 0.1-40%, 0.1-10%, 0.5-10%, or 1-5%. Likewise, the amount of each refractory metal, so long as ruthenium is the single largest constituent and the total weight percentage of any combination of refractory metals does not exceed 10 wt %, may be: greater than or equal to 0.1 wt %, 0.5 wt %, 1 wt %, or 2 wt %; less than or equal to 10 wt %, 8 wt %, 6 wt %, or 5 wt %; or between 0.1-10 wt %, 0.5-9 wt %, 0.5-8 wt %, or 0.5-5 wt %. The preceding amounts, percentages, limits, ranges, etc. are only examples of the wide variety of ruthenium-based material compositions that are possible; they are not meant to limit the scope of the ruthenium-based material.

One or more rare earth metals may be added to any of the various ruthenium-based materials described above. The rare earth metal(s) employed may be any one of, or some combination of, yttrium (Y), hafnium (Hf), scandium (Sc), zirconium (Zr), lanthanum (La), or cerium (Ce), to name but a few. Those skilled in the art will appreciate that such metals can trap interstitial components in much the same way as the refractory metal(s). This trapping capability helps keep the interstitial components and other impurities from accumulating—due to their low solubility in ruthenium—as fine precipitates at the grain boundaries of the ruthenium-based material. And reducing the amount of interstitial compounds at the grain boundaries is thought to increase the ductility of the ruthenium-based material through several mechanisms including, most notably, pinning of the grain boundaries and grain growth inhibition during hot forming processes. The content of these rare earth metals in the ruthenium-based material preferably ranges from about 1 ppm to about 0.3 wt %.

The several embodiments of the ruthenium-based material described above exhibit favorable oxidation, corrosion, and erosion resistance that is desirable in certain ignition applications including, for instance, spark plugs designed for an internal combustion engine. The relatively high melting temperature (2334° C.) of ruthenium is believed responsible, at least in part, for some of these physical and chemical characteristics. But these embodiments also have a tendency to possess less-than-desirable room-temperature ductility—which affects how easily they can be fabricated or manufactured into a useable piece. For this reason, the ruthenium-based material may be clad with a more ductile material to accommodate fabrication, as desired, by a wide variety of hot metal forming processes and to avoid thermal shock.

Figure 6:
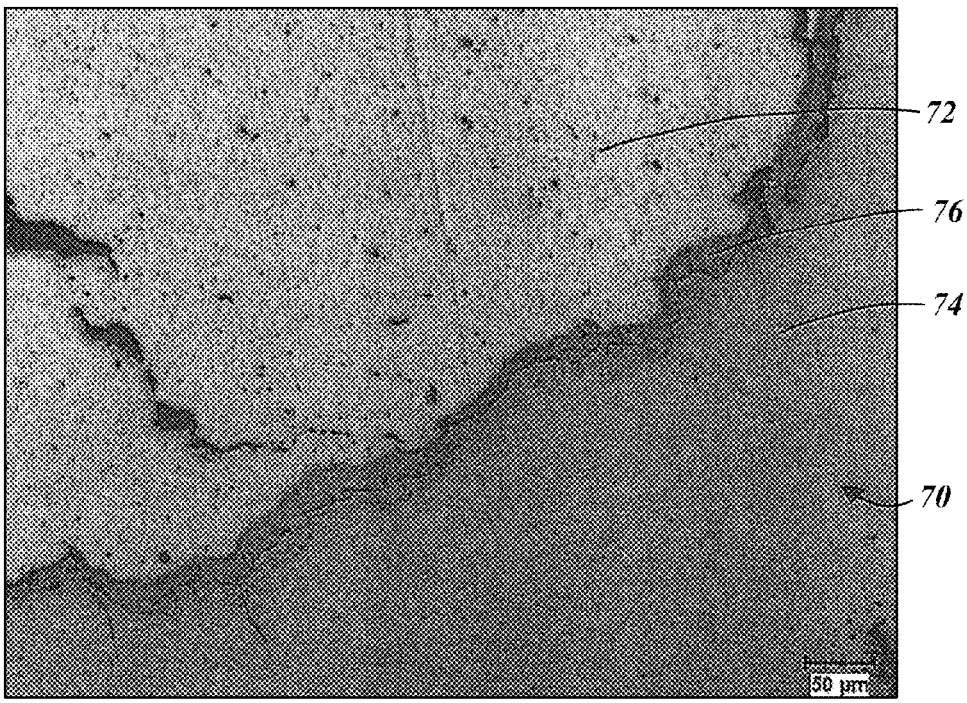
FIG. 6 is a magnified cross-sectional image of a wire—following hot-drawing to a diameter of about 3 mm—that includes a ruthenium-based material core, a Ni—Cr—Al alloy cladding encasing the core, and an Al-rich intermetallic phase susceptible to cracking that is formed adjacent to the interface between the core and the cladding.
Figure 8:
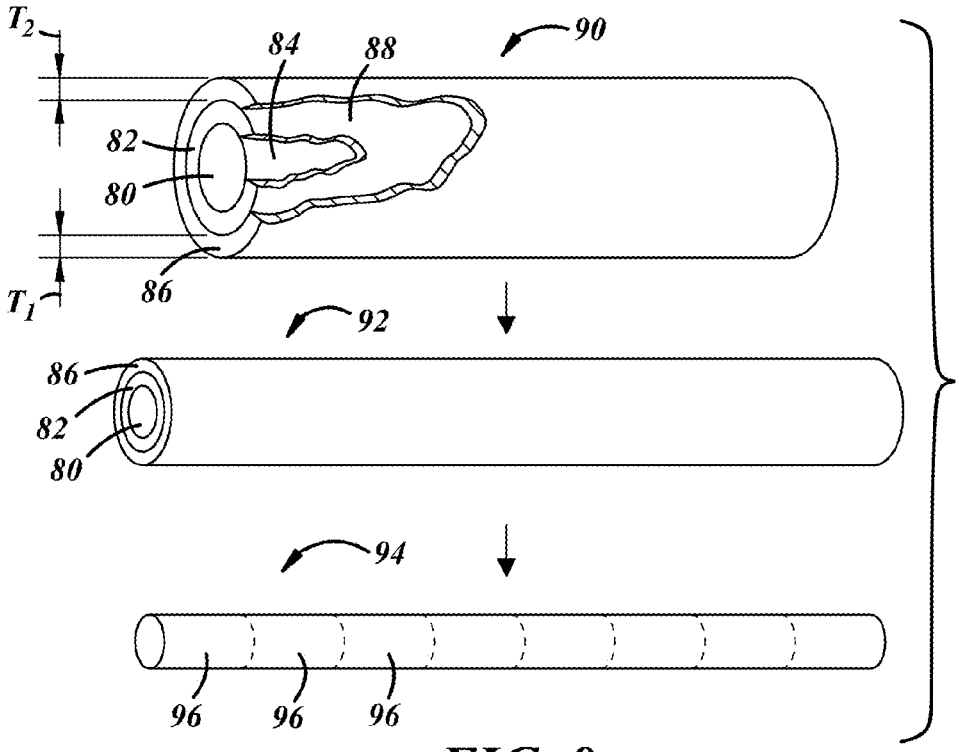
FIG. 8 is a illustration showing, in general, the transformation of a ruthenium-based material core into an elongated ruthenium-based material wire according to the method depicted in FIG. 7.
Figure 7:
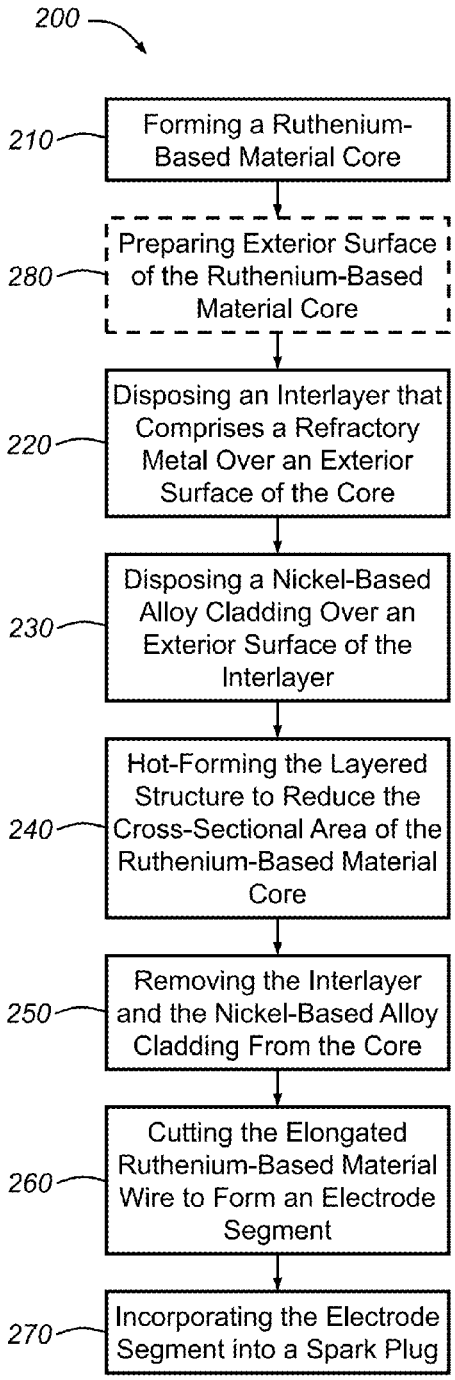
FIG. 7 is a flowchart illustrating an exemplary method for forming a ruthenium-based material into a useable part for an ignition device.

A cladding that has been used before with other types of precious metal-based electrode materials (e.g., Ir- and Pt-based) is a nickel-based alloy such a nickel-chromium-aluminum (Ni—Cr—Al) alloy or a nickel-iron-aluminum alloy (Ni—Fe—Al). But while encasing a core of the ruthenium-based material with a nickel-based cladding and then hot-forming the structure can help fabricate the ruthenium-based material with greater ease, it can also promote structural defects on the surface of the ruthenium-based material core, which are generally undesirable for spark plug applications. Surface cracking of the ruthenium-based material core to a depth of up to about 25 μm is one particular structural defect that has been observed. Such surface cracking is believed to be caused by the diffusion of certain low-melting point alloy constituents—namely, aluminum—from the nickel-based cladding into the ruthenium-based material core at elevated temperatures. More specifically, the diffused alloy constituents are thought to react with the ruthenium-based material to produce an intermetalic phase that is present within the ruthenium-based material core adjacent to the interface between the core and the cladding. This intermetalic phase is relatively brittle, and thus, susceptible to cracking when the types of stresses normally associated with hot forming are applied. For example, FIG. 6 shows a cross-sectional image of a wire 70 that includes a ruthenium-based material core 72, in which the ruthenium-based material is Ru-5Rh-1Ir-1Re, encased by a Ni—Cr—Al alloy cladding 74. The cross-sectional image was taken after the wire 70 was hot-drawn to an outer diameter of about 3 mm. As can be seen, an intermetallic phase 76—presumably a Ru—Al intermetallic phase—that appears more susceptible to cracking has formed at or near the interface between the core 72 and the cladding 74.

A method of manufacturing a ruthenium-based material into a desired form that is suitable to derive a spark plug electrode or electrode component is graphically and schematically illustrated in FIGS. 7-12. The method is identified in FIG. 7 as numeral 200 and comprises at least the steps of: forming a ruthenium-based material core 80 having a length L and a cross-sectional area CA taken perpendicular to the length L dimension, step 210; disposing an interlayer 82 that comprises a refractory metal over an exterior surface 84 of the ruthenium-based material core 80, step 220; disposing a nickel-based alloy cladding 86 over an exterior surface 88 of the interlayer 82 to form a layered structure 90, step 230; hot-forming the layered structure 90 to reduce the cross-sectional area CA of the ruthenium-based material core 80 and to form an elongated layered wire 92, step 240; and removing the interlayer 82 and the nickel-based alloy cladding 86 from the ruthenium-based material core 80 to derive an elongated wire 94 of the ruthenium-based material, step 250. Additional steps that may also be practiced include: cutting the elongated wire 94 into individual pieces to form electrode segments 96, step 260; and incorporating the electrode segment 96 into a spark plug, step 270. The disclosed method helps avoid the diffusion of low-melting point alloy constituents into the ruthenium-based material core 80 during hot-forming and, additionally, may be practiced in a way that improves the high-temperature erosion resistance of the resultant ruthenium-based material wire 94 by generating a "fibrous" grain structure, as will be further explained below.

Figure 11:
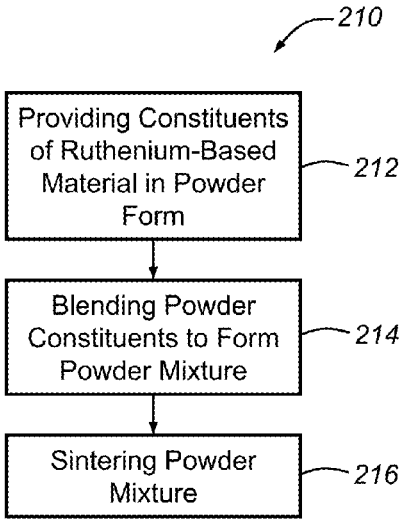
FIG. 11 is a flowchart illustrating an exemplary embodiment for performing the forming step of FIG. 7.
Figure 12:
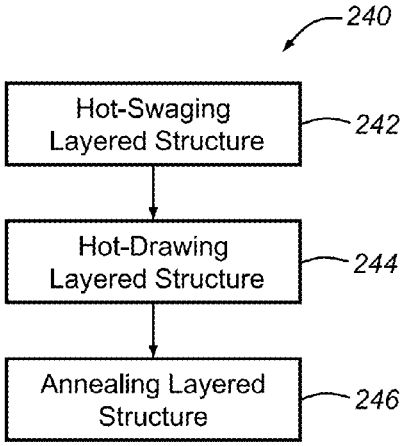
FIG. 12 is a flowchart illustrating an exemplary embodiment for performing the hot-forming step of FIG. 7.
Figure 9:
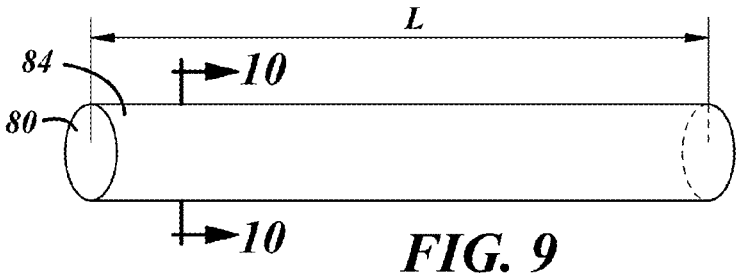
FIG. 9 is a generalized illustration of one embodiment of the ruthenium-based material core that may be formed during the forming step of FIG. 7.
Figure 10:
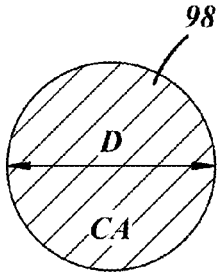
FIG. 10 is a cross-sectional illustration of the ruthenium-based material core shown in FIG. 9.

The forming step 210 is preferably carried out by a powder metallurgy process, as graphically illustrated in FIG. 11, that involves providing the constituents of the ruthenium-based material in powder form, step 212; blending the powder constituents together to form a powder mixture, step 214; and sintering the powder mixture to form the ruthenium-based material core 80, step 216. The different constituents of the ruthenium-based material may be provided in powder form at a certain powder or particle size in any known manner. According to one exemplary embodiment, ruthenium, one or more precious metals (e.g., rhodium, iridium, platinum, palladium, gold), and one or more refractory metals (rhenium, tungsten, etc.) are individually provided in powder form with each of the constituents having a particle size ranging from about 0.1 μm to about 200 μm, inclusive. In another embodiment, the ruthenium and one or more of the constituents are pre-alloyed and formed into a base alloy powder first, before being mixed with the other powder constituents. The non-pre-alloying embodiment may be applicable to more simple systems (e.g., Ru—Re—W), while the pre-alloyed embodiment may be better suited for more complex systems (e.g., Ru—Rh—Ir—Re, Ru—Rh—Ir—W, Ru—Rh—Ir—Re/W, etc.). Pre-alloying of the ruthenium and other alloy constituents—exclusive of the refractory metal(s) (for example, Re and W)—into a base alloy powder, and then mixing the base alloy powder with those refractory metal(s), may also promote grain boundary enrichment with the refractory metal constituency.

Next, in step 214, the powders may be blended together to form a powder mixture. In one embodiment, for example, the powder mixture includes from about 40 wt % to 99.9 wt % of ruthenium, from about 0.5 wt % to 5 wt % of rhodium, from about 0.1 wt % to 5 wt % iridium, and from about 0.1 wt % to 5 wt % rhenium and/or tungsten, regardless of whether a pre-alloyed base alloy powder was formed or not. This mixing step may be performed with or without the addition of heat.

The sintering step 216 transforms the powder mixture into the ruthenium-based material core 80 through the application of heat. The sintering step 216 may be performed according to a number of different metallurgical embodiments. For instance, the powder mixture may be sintered in a vacuum, in a reduction atmosphere such as in a hydrogen-contained environment, or in some type of protected environment for up to several hours at an appropriate sintering temperature. Oftentimes an appropriate sintering temperature lies somewhere in the range of about 1350° C. to about 1650° C. for the ruthenium-based powder mixture. It is also possible for the sintering step 216 to apply pressure in order to introduce some type of porosity control. The amount of pressure applied may depend on the precise composition of the powder mixture and the desired attributes of the ruthenium-based material core 80.

The ruthenium-based material core 80 that results following the sintering step 216 is preferably shaped as a bar or other elongated structure. The length L of the bar represents the longitudinal—and largest—dimension of the bar, and the cross-sectional area CA is the planar surface area of an end 98 of the bar when sectioned perpendicular to the length L dimension, as depicted generally in FIGS. 9-10. The sintering step 216, moreover, is preferably practiced in a way that results in a cylindrical bar having a diameter D. A bar—whether cylindrical or non-cylindrical—of the ruthenium-based material in which the cross-sectional area CA ranges from about 79 $mm^2$ (about 10 mm diameter if cylindrical) to about 707 $mm^2$ (about 30 mm diameter if cylindrical), for instance about 314 $mm^2$ (about 20 mm diameter if cylindrical), and the length L ranges from about 0.5 m to about 2.0 m, for instance about 1 m, is generally acceptable. But such preferred geometrical measurements are by no means exclusive.

The exterior surface 84 of the ruthenium based-material core 80 may now be prepared, if desired, to receive the interlayer 82, as indicated by optional step 280. Such preparation is generally directed to cleaning the exterior surface 84 so that a strong retention capacity can be realized at the interface of the interlayer 82 and the core 80. The exterior surface 84 of the ruthenium-based material core 80 may be polished, sanded, ground, acid washed, or subjected to any other surface treatment that can remove grease and other undesirable surface contaminants from the exterior surface 84.

Following the forming step 210 (and the preparation step 280 if practiced), the interlayer 82 is disposed over, and preferably into direct contact with, the exterior surface 84 of the ruthenium-based material core 80. The interlayer 82 may include at least one refractory metal selected from the group of niobium (Nb), molybdenum (Mo), tantalum (Ta), tungsten (W), and rhenium (Re). For example, the interlayer 82 may be composed entirely (100 wt %) of any one of those refractory metals, or it may be an alloy of one or more of those refractory metals so long as the weight percentage of the refractory metal(s) in the alloy is greater than about 50 wt %, greater than about 75 wt %, or greater than about 90 wt %. A few preferred compositions of the interlayer 82 are about 100 wt % molybdenum, an alloy that includes at least 50 wt. % of molybdenum, and an alloy that includes molybdenum and tungsten as the two largest constituents on a weight percent basis with the combined weight percent of the two metals being greater than about 50 wt %.

The interlayer 82 has a thickness T1 that typically ranges from about 50 μm to about 2000 μm—more preferably from about 200 μm to about 500 μm. Disposing the interlayer 82 over the exterior surface 84 of the ruthenium-based material core 80 at this thickness establishes a diffusion barrier that keeps low-melting point elements (e.g., aluminum) that may be present in the nickel-based cladding 88 from diffusing into the ruthenium-based material core 80 during hot-forming. The interlayer 82 can function as a diffusion barrier because the one or more refractory metals—which have relatively high melting points—render it heat-, wear-, and chemically-resistant at the types of temperatures encountered during the hot-forming step 240. As such, low-melting point alloy constituents that may diffuse from the nickel-based cladding 86 during hot-forming are unable to infiltrate into the ruthenium-based material core 80 in quantities sufficient to produce a brittle intermetallic phase. Perhaps equally noteworthy is the fact that the interlayer 82 does not make the underlying ruthenium-based material core 80 exceedingly difficult to hot-form. The thickness T1 of the intermetallic layer 82, while sufficient to serve as a diffusion barrier, is also moderate enough that hot-forming the layered structure 90 is not overly cumbersome.

Any suitable procedure may be used to dispose the interlayer 82 over the exterior surface 84 of the ruthenium-based material core 80. Some available procedures that may be employed include co-extrusion, laser cladding, electroplating, electroless plating, plasma spray physical vapor deposition, magnetron sputtering, microwave assisted chemical vapor deposition, plasma enhanced chemical vapor deposition, mechanically inserting the core 80 into a pre-formed hollow interlayer 82, or any other type of extrusion, electrodeposition, physical vapor deposition, chemical vapor deposition, or other procedure that is able to situate the interlayer 82 over the core 80.

The nickel-based alloy cladding 86 is disposed over, and preferably into direct contact with, the exterior surface 88 of the interlayer 82 to form the layered structure 90, as graphically depicted in step 230. The nickel-based alloy cladding 86 may be a nickel-chromium-aluminum (Ni—Cr—Al) alloy or a nickel-iron-aluminum alloy (Ni—Fe—Al). Any suitable procedure may be used to dispose the nickel-based alloy cladding 86 over the exterior surface 88 of the interlayer 82. For example, the nickel-based alloy cladding 86 may be extruded or otherwise fabricated into a hollow tube, and the combination core 80 and interlayer 82 structure may be inserted into the hollow tube to achieve a tight fit, thus producing the layered structure 90 shown in FIG. 8. The procedures mentioned above in connection with the interlayer 82 may also be practiced. The exact thickness of the nickel-based alloy cladding 86 applied by any of these procedures depends on a variety of factors. In general, however, the nickel-based alloy cladding 86 has a thickness T2 equal to or greater than the thickness T1 of the interlayer 82. Anywhere from about 1 mm to about 5 mm is usually sufficient for the thickness T2 of the nickel-based alloy cladding 86 before the hot-forming step 240. Upward or downward deviations are permissible though, if warranted.

The layered structure 90 is then hot-formed, as graphically represented by step 240, to reduce the cross-sectional area CA of the ruthenium-based material core 80—and, coincidentally, to increase its length L—to form the elongated layered wire 92. The cross-sectional area CA of the ruthenium-based material core 80 may be reduced by at least 60%, at least 80%, or at least 95%, with cross-sectional area reductions greater than 99% not being uncommon. The hot-forming step 240, as further described below, preferably includes a hot-swaging step 242, at least one hot-drawing step 244, and at least one annealing step 246, as shown graphically in FIG. 12. But like the forming step 210, skilled artisans will appreciate that other processes may be performed in addition to, or in lieu of, hot-swaging and hot-drawing, such as hot-rolling and hot-extrusion, and still achieve the same objectives. Such other steps are intended to be encompassed by the term "hot-forming" and its grammatical derivations (e.g., "hot-form," "hot-formed," etc.). In the following discussion, a layered structure 90 in which the ruthenium-based material core 80 is a cylindrical bar having a cross-sectional area of about 314 $mm^2$ (about 20 mm diameter) and a length of about 1 m has been selected for demonstrating the effects of the hot-forming step 240 on the cross-sectional area of the core 80 as the layered structure 90 is transformed into the elongated layered wire 92. The selection of these particular geometrical measurements is not meant to be limiting in any way; rather, their selection is intended to be demonstrative only.

The hot-swaging step 242 involves radially hammering or forging the layered structure 90 at a temperature above the ductile-brittle transition temperature of the ruthenium-based material. A temperature that lies in the range of about 900° C. to about 1500° C. is usually sufficient for this purpose. The heated compressive metalworking that takes place during hot-swaging reduces the cross-sectional area CA of the ruthenium-based material core 80 and, consequently, effectuates work-hardening of the entire layered structure 90. The cross-sectional area CA of the ruthenium-based material core 80 may be reduced by about 30% to about 80%. For example, the exemplary ruthenium-based cylindrical bar preferably formed as the core 80 by the powder metallurgy process (steps 212-216) may, following a 75% reduction in cross-sectional area by hot-swaging, have a cross-sectional area CA of about 79 $mm^2$ (about 10 mm diameter) and a length of about 4 m.

The hot-drawing step 244 includes drawing the layered structure 90—after hot-swaging—through an opening defined in a heated draw plate. The draw plate opening is appropriately sized to further reduce the cross-sectional area CA of the ruthenium-based material core 80. The temperature of the draw plate may be maintained at a temperature that heats the ruthenium-based material above its ductile-brittle transition temperature. Heating the draw plates so that the temperature of the ruthenium-based material core 80 ranges from about 900° C. to about 1300° C. is typically sufficient for conducting hot-drawing of the layered structure 90. The hot-drawing step 244 may further reduce the cross-sectional area of the ruthenium-based material core 80 by up to about 75%, preferably from about 20% to about 50%, with each pass through the draw plate. For example, the exemplary ruthenium-based cylindrical bar preferably formed by the powder metallurgy process (steps 212-216) and the hot-swaging process (step 242) may, following another 75% cross-sectional area reduction by a single hot-drawing pass, have a cross-sectional area of about 20 $mm^2$ (about 5 mm diameter) and a length of about 16 m.

Figure 13:
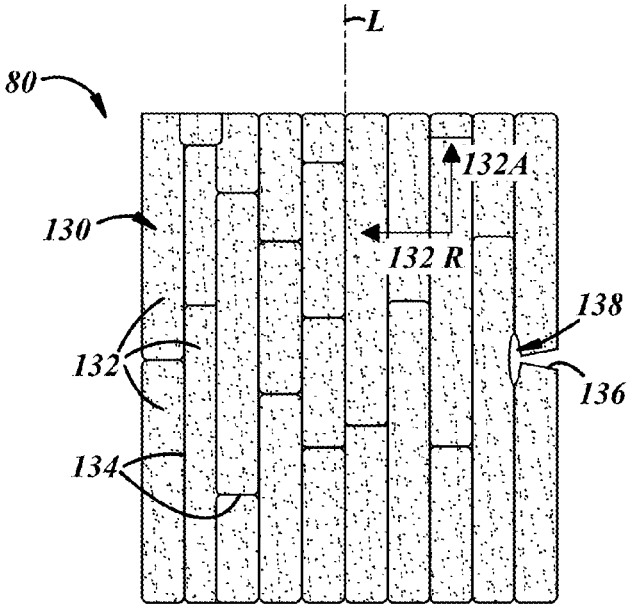
FIG. 13 is a generalized partial illustration of a ruthenium-based material core that includes a "fibrous" grain structure.
Figure 14:
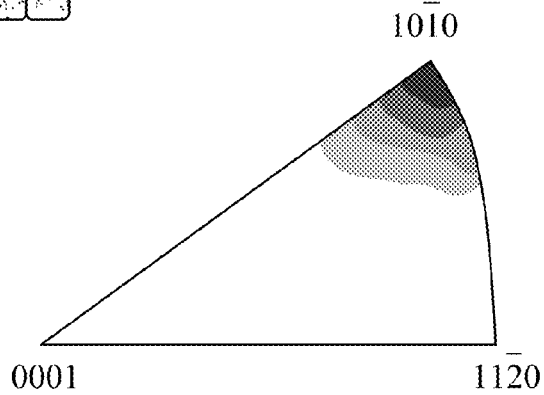
FIG. 14 is a plot showing an extrusion-axis inverse pole figure for a ruthenium-based material core having the "fibrous" grain structure illustrated in FIG. 13.

The hot-drawing step 244 may generate a "fibrous" grain structure in the ruthenium-based material core 80 along its length L dimension (i.e., the elongation axis of the layered structure 90) as the layered structure 90 is pulled through the heated die plate opening. An example of the "fibrous" grain structure (or elongated grain structure) is shown generally and schematically in FIG. 13 and is identified by reference numeral 130. The "fibrous" grain structure comprises elongated grains 132 defined by grain boundaries 134. Each of these grains 132 has an axial dimension 132A—which is aligned directionally with the length dimension L of the core 80—and a radial dimension 132R—which is aligned directionally transverse to the length dimension L. The axial dimension 132A of the grains 132 is generally greater than the radial dimension 132R by a multiple of two or more, and, typically, six or more (e.g., 132A≥6×132R). The grains 132 are also oriented generally parallel to one another; that is, the axial dimensions 132A of the grains 132 are generally—but not necessarily exactly—aligned in parallel. Strict parallelism is not required for the grains 132 to be considered generally parallel. Some leeway is tolerated so long as the grains 132 as a group have their axial dimensions 132A extending in the same general direction. Moreover, as shown in FIG. 14, the elongated grains 132 may also have a crystal orientation (sometimes referred to as a "texture") in which the dominant grains have their [0001] hexagonal axis of crystals generally perpendicular to axial dimensions 132A of the grains 132. The terms "axial dimension" and "radial dimension" are used here to broadly denote the major dimensions of the grain 132; they are not intended to suggest that the grains 132 are necessarily restricted to being cylindrical in shape.

The "fibrous" grain structure 130 may improve the room-temperature ductility and high-temperature durability of the ruthenium-based material compared to other grain structures. The improved ductility makes the ruthenium-based material core 80 more workable and, thus, easier to fabricate into the elongated wire 92, while the improved durability helps mitigate erosion when the ruthenium-based material is ultimately exposed to high-temperature environments for an extended period of time as part of a spark plug. The "fibrous" grain structure 130 is believed to improve ductility, reduce intergranular grain loss, and improve high-temperature durability by inhibiting crack propagation transverse to the axial dimensions 132A of the grains 132. This so called "crack blunting" phenomenon is illustrated in FIG. 13. There, it can be seen that a surface-initiated crack 136 can propagate only a small distance into the material before being blunted at a contiguous interfacial region 138 of neighboring interior grain 132. Such extensive crack blunting capabilities are not attainable by grain structures in which the grains are less elongated and more equiaxed, and thus more susceptible to segregation and cleavage.

The cross-sectional area reductions achieved during the hot-swaging step 242 and the hot-drawing step 244 generally require annealing of the layered structure 90, as graphically represented in step 246, to permit further hot-forming. Annealing the layered structure 90 involves heating it for a period of several seconds to several minutes to relieve material stresses. Heating the layered structure to a temperature above about 1000° C., for example, is generally sufficient. The layered structure 90 may be annealed at least once for every 75% reduction—more preferably at least once for every 50% reduction—in the cross-sectional area CA of the ruthenium-based material core 80. This means the layered structure 90 may be annealed after each of the hot-swaging step 242 and the hot-drawing step 244, or after the hot-drawing step 244 only depending on the cross-sectional area reduction attained during hot-swaging.

The layered structure 90 is preferably annealed during hot-forming—in particular after the hot-drawing step 244—in a manner that preserves the "fibrous" grain structure 130. This may involve annealing the layered structure 90 at a temperature below the recrystallization temperature of the ruthenium-based material that comprises the core 80. An annealing temperature between about 1000° C. to about 1500° C. is generally sufficient to prevent loss of the "fibrous" grain structure 130. The inclusion of the refractory metal(s) (Re and/or W, for example) in the ruthenium-based material, moreover, makes preserving the "fibrous" grain structure 130 that much easier on account of the ability of those metals to increase the recrystallization temperature of the ruthenium-based material. Any annealing that may be required after the hot-swaging step 242, but before the hot-drawing step 244, may be performed with less attention paid to the effects of recrystallization since the "fibrous" grain structure 130 sought to be preserved is likely not present at that time.

The hot-drawing step 244 and the annealing step 246 may be repeated one or more times to derive the elongated layered wire 92. That is, the layered structure 90 may be hot-drawn, then annealed to relieve internal stress, then hot-drawn again, then annealed again, and so on, until the ruthenium-based material core 80 has reached the desired size, with annealing being performed at least once for every 75% reduction in the cross-sectional area CA of the ruthenium-based material core 80. Multiple hot-drawing operations—in which the layered structure 90 is drawn through successively smaller heated die plate openings—may have to be performed in conjunction with intermittent annealing because the ruthenium-based material core 80 may only be able to withstand a certain amount of cross-sectional area reduction before suffering undesirable structural damage. The cross-sectional area CA of the ruthenium-based material core 80 in the elongated layered wire 92 may vary widely depending on the expected end-use of the ruthenium-based material. For example, the exemplary ruthenium-based cylindrical bar preferably formed by the powder metallurgy process (steps 212-216), the hot-swaging process (step 242), and a single hot-drawing process (step 244), following another 98% cross-sectional area reduction by several hot-drawing processes (step 244), may have a cross-sectional area of about 0.4 $mm^2$ (about 0.7 mm diameter) and a length of about 816 m, assuming the layered structure 90 was not severed into smaller portions along the way.

After the elongated layered wire 92 is produced by the hot-forming step 240, the interlayer 82 and the nickel-based alloy cladding 86 may be removed from the ruthenium-based material core 80, as graphically represented in step 250, to derive the elongated ruthenium-based material wire 94. Any suitable physical and/or chemical procedure may be practiced to remove the interlayer 82 and the nickel-based alloy cladding 86. Chemical etching is one particular way in which the two layers 82, 86 may be removed. The interlayer 82 and the nickel-based alloy cladding may be etched at the same time with the same acid, or they may be etched successively by different acids. A few examples of an acid that may be used to etch the interlayer 82 and the nickel-based alloy cladding 86 are HCl and $HNO_3$. The use of known mechanical measures to separate and peel the interlayer 82 and the overlying nickel-based alloy cladding 86 away from the ruthenium-based material core 80 may also be practiced in addition to, or in lieu of, chemical etching. Of course other procedures that can remove the interlayer 82 and the nickel-based cladding 86 may be practiced as well despite not being mentioned here.

The elongated ruthenium-based material wire 94 may now be cut to form an electrode segment 96 as graphically represented in step 260. The electrode segment 96—many of which may be cut from the elongated ruthenium-based material wire 94—may be sized and shaped for use as any of the electrodes or electrode firing tip components shown in FIGS. 1-5 or described herein. Shearing, a diamond saw, or any other suitable approach may be employed to cut the elongated ruthenium-based material wire 94 to obtain the electrode segment 96.

The electrode segment 96 obtained from the elongated ruthenium-based material wire 94 may be incorporated into spark plug in step 270. Following hot-forming (step 240) and removal of the interlayer 82 and the nickel-based alloy cladding 86 (step 250), for example, the ruthenium-based material wire 94 may have a cross-sectional area between about 0.07 $mm^2$ (about 0.30 mm diameter if cylindrical) to about 0.95 $mm^2$ (about 1.1 mm diameter if cylindrical). One specific embodiment of the ruthenium-based material wire 94 that may be useful is a cylindrical-shaped wire characterized by a cross-sectional area of about 0.4 $mm^2$ (0.70 mm diameter). An individual electrode segment 96 of a desired length may be cut from the wire 94 of this general size ($0.07\ mm^2 \leq CA \leq 0.95\ mm^2$), as indicated in step 260, and then be directly used as a firing tip component attached to a center electrode, a ground electrode, an intermediate component, etc. In particular, the individually cut electrode segment 96 may be used as the firing tip component 32 attached to the intermediate component 34 on the center electrode 12 depicted in FIGS. 1-2. The process 200 described above may of course be practiced to form a ruthenium-based material electrode segment 96 suitable for other spark plug electrode and/or firing tip applications not specifically mentioned here.

Figure 15:
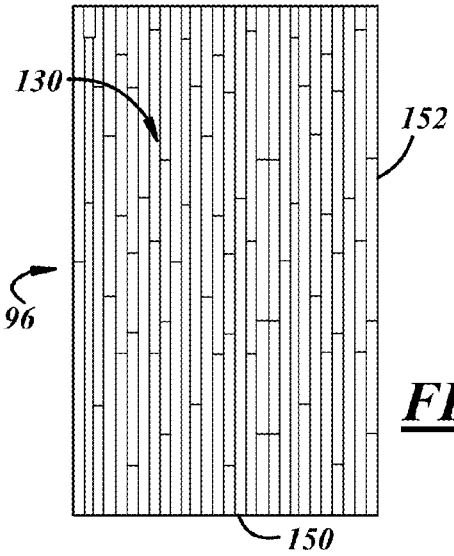
FIG. 15 is a generalized illustration of an electrode segment cut from an elongated ruthenium-based material wire that includes the "fibrous" grain structure illustrated in FIG. 13.

If the elongated wire 94 includes a "fibrous" grain structure 130, as discussed earlier, then the electrode segment 96 is preferably employed in any of the spark plugs shown in FIGS. 1-5 so that a surface 150 of the segment 96 normal to the axial dimensions 132A of the grains 132 (hereafter "normal surface 150" for brevity) constitutes the sparking surface, as shown in FIG. 15. Such an orientation of the electrode segment 96 within the spark plug 10 may result in the axial dimensions 132A of the grains 132 lying parallel to a longitudinal axis $L_C$ of the center electrode 12 (FIG. 2) if the electrode segment 96 is attached to the center electrode 12 or the ground electrode 18. For example, if the electrode segment 96 is used as the firing tip 32 for the multi-layer rivet (MLR) design shown in FIGS. 1-2, the normal surface 150 preferably faces the firing tip 30 attached to the ground electrode 18. In doing so, the axial dimensions 132A of the grains 132 lie parallel to the longitudinal axis $L_C$ of the center electrode 12 and perpendicular to the sparking surface of the firing tip 32. The electrode segment 96 is also preferably used in the same way for the other firing tip components 40, 50, shown in FIGS. 3-4. Likewise, as another example, if the electrode segment 96 is used as a firing tip 30, 42 attached to the ground electrode 18 in the designs shown in FIGS. 1-3, the normal surface 150 preferably faces the firing tip 32, 40 on the center electrode 12. In these embodiments, the axial dimensions 132A of the grains 132 lie parallel to the longitudinal axis $L_C$ of the center electrode 12, as before, and perpendicular to the sparking surface of the firing tip 32, 40. Using another surface of the electrode segment 96—besides the normal surface 150—as the sparking surface, although not as preferred, may still be practiced. For example, if the electrode segment 96 is used as the firing tip 60 for the design shown in FIG. 5, the normal surface 150 of the segment 96 may not face the firing tip 62 attached to the ground electrode 18; instead, a side surface 152 may face the firing tip 62 and act as the sparking surface.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method of manufacturing a spark plug electrode material into a desired form, the method comprising the steps of:

forming a core of a ruthenium-based material that has a length dimension and a cross-sectional area oriented perpendicular to the length dimension, the ruthenium-based material having ruthenium (Ru) as the single largest constituent on a weight percentage (wt %) basis;

disposing an interlayer that comprises a refractory metal over an exterior surface of the ruthenium-based material core;

disposing a nickel-based alloy cladding over an exterior surface of the interlayer to form a layered structure;

hot-forming the layered structure to reduce the cross-sectional area of the ruthenium-based material core to form an elongated layered wire; and removing the interlayer and the nickel-based alloy cladding from the ruthenium-based material core to derive an elongated ruthenium-based material wire.

2. The method set forth in claim 1, further comprising the steps of:

cutting the elongated ruthenium-based material wire to form an electrode segment; and incorporating the electrode segment into a spark plug.

3. The method set forth in claim 2, wherein the hot-forming step is performed so that the elongated layered wire comprises a fibrous grain structure that includes elongated grains with axial dimensions oriented generally parallel to the length dimension of the core, and wherein incorporating the electrode segment into a spark plug comprises employing the electrode segment so that a surface of the electrode segment normal to the axial dimensions of the elongated grains constitutes a sparking surface.

4. The method of claim 1, wherein the hot-forming step reduces the cross-sectional area of the layered structure by at least 95% to form the elongated layered wire.

5. The method set forth in claim 4, wherein the hot-forming step comprises:

hot-drawing the layered structure through a heated die plate at least once to reduce the cross-sectional area of the ruthenium-based material core; and annealing the layered structure at least once for every 75% reduction in the cross-sectional area of the layered structure, the annealing being performed at a temperature that is below the recrystallization temperature of the ruthenium-based material that comprises the core.

6. The method set forth in claim 5, wherein the hot-forming step further comprises:

hot-swaging the layered structure before hot-drawing.

7. The method set forth in claim 1, wherein the interlayer has a thickness that ranges from about 50 μm to about 2000 μm.

8. The method set forth in claim 1, wherein the nickel-based alloy cladding has a thickness that is equal to or greater than the thickness of the interlayer.

9. The method set forth in claim 1, wherein the core of ruthenium-based material comprises, in addition to ruthenium, one or more precious metals selected from the group consisting of iridium, platinum, palladium, gold, and combinations thereof, and one or more refractory metals selected from the group consisting of rhenium, tungsten, and combinations thereof.

10. The method set forth in claim 1, wherein the core of ruthenium-based material comprises 0.1-40 wt. % of rhodium, iridium, platinum, palladium, gold, or a combination thereof, 0.1-10 wt. % of rhenium, tungsten, or a combination of rhenium and tungsten, and the balance ruthenium.

11. A method of manufacturing a spark plug electrode material into a desired form, the method comprising the steps of:

providing a layered structure that comprises (1) a core of a ruthenium-based material that has a length dimension and a cross-sectional area oriented perpendicular to the length dimension, the ruthenium-based material having ruthenium (Ru) as the single largest constituent on a weight percentage (wt %) basis, (2) an interlayer that comprises a refractory metal disposed over an exterior surface of the ruthenium-based material core, and (3) a nickel-based alloy cladding disposed over an exterior surface of the interlayer;

hot-drawing the layered structure through an opening defined in a heated draw plate along the length dimension of the core to reduce the cross-sectional area of the ruthenium-based material core;

annealing the layered structure;

repeating the hot-drawing and annealing steps to reduce the cross-sectional area of the ruthenium-based material core by at least 80% to form an elongated layered wire; and removing the interlayer and the nickel-based alloy cladding from the ruthenium-based material core to derive an elongated ruthenium-based material wire.

12. The method set forth in claim 11, further comprising:

hot-swaging the ruthenium-based material, before hot-drawing, at a temperature above the ductile-brittle temperature of the ruthenium-based material.

13. The method set forth in claim 12, further comprising:

cutting the elongated ruthenium-based material wire to form an electrode segment; and incorporating the electrode segment into a spark plug.

14. The method set forth in claim 13, wherein incorporating the electrode material into a spark plug comprises attaching the electrode segment to a center electrode by way of an intermediate firing tip component.

15. The method set forth in claim 11, wherein the hot-drawing step provides the ruthenium-based material core with a fibrous grain structure that includes elongated grains with axial dimensions oriented generally parallel to the length dimension of the core, and wherein the annealing step is performed at a temperature that maintains the elongated grains.

16. The method set forth in claim 15, further comprising the steps of:

cutting the elongated ruthenium-based material wire to form an electrode segment; and attaching the segment of the ruthenium-based electrode material to a center electrode or a ground electrode such that a surface of the electrode segment normal to the axial dimensions of the elongated grains constitutes a sparking surface.

17. A layered structure for use in a spark plug electrode, comprising:

a core of a ruthenium-based material that has an exterior surface, a length dimension and a cross-sectional area oriented perpendicular to the length dimension, the ruthenium-based material having ruthenium (Ru) as the single largest constituent on a weight percentage (wt %) basis;

an interlayer that has an exterior surface and is disposed over the exterior surface of the ruthenium-based material core, the interlayer having at least one refractory metal; and a nickel-based alloy cladding disposed over the exterior surface of the interlayer, the nickel-based alloy cladding having nickel (Ni) as the single largest constituent on a weight percentage (wt %) basis;

wherein the interlayer and nickel-based alloy cladding are arranged as temporary layers to be removed at a subsequent manufacturing stage.

18. The layered structured set forth in claim 17, wherein the ruthenium-based material core is comprised of a ruthenium-based material selected from the group consisting of: Ru-(0.5-5)Rh—Re(0.1-5), Ru-(0.5-5)Rh-(0.1-5)W, Ru-(0.5-5)Rh-(0.1-5)Re/W, Ru-(0.5-5)Rh-(0.1-5)Ir-(0.5-5)Re, Ru-(0.5-5)Rh-(0.1-5)Ir-(0.5-5)W, Ru-(0.5-5)Rh-(0.1-5)Ir-(0.5-5)Re/W, Ru-(1-10)Rh-(1-10)Ir-(0.5-5)Re-(0.5-5)W, and Ru-(1-10)Rh-(1-10)Ir-(0.5-5)Re-(0.5-5)W, wherein Re/W constitutes a combination of rhenium and tungsten, and wherein all of the numerical values listed are in weight percentage.

* * * * *